US009915015B2

(12) United States Patent
Verclyte et al.

(10) Patent No.: US 9,915,015 B2
(45) Date of Patent: Mar. 13, 2018

(54) SELVEDGE FORMING DEVICE FOR A WEFT THREAD

(71) Applicant: PICANOL, Ieper (BE)

(72) Inventors: Eddy Verclyte, Ieper (BE); Wim Hoorelbeke, Wevelgem (BE); Ronny Coulembier, Ieper (BE)

(73) Assignee: Picanol, Ieper (BE)

( * ) Notice: Subject to any disclaimer, the term of this patent is extended or adjusted under 35 U.S.C. 154(b) by 0 days.

(21) Appl. No.: 15/311,357

(22) PCT Filed: May 27, 2015

(86) PCT No.: PCT/EP2015/061737

§ 371 (c)(1),
(2) Date: Nov. 16, 2016

(87) PCT Pub. No.: WO2015/189033

PCT Pub. Date: Dec. 17, 2015

(65) Prior Publication Data

US 2017/0107648 A1 Apr. 20, 2017

(30) Foreign Application Priority Data

Jun. 13, 2014 (BE) ..... 2014/0451

(51) Int. Cl.
*D03C 7/06* (2006.01)
*D03D 47/48* (2006.01)
*D03C 7/00* (2006.01)

(52) U.S. Cl.
CPC ..... *D03D 47/48* (2013.01); *D03C 7/06* (2013.01)

(58) Field of Classification Search
CPC ... D03C 7/06; D03C 7/00; D03C 7/08; D03C 13/00; D03C 7/04; D03D 47/48; D03D 19/00; D03D 47/40
See application file for complete search history.

(56) References Cited

U.S. PATENT DOCUMENTS 3,083,738 A * 4/1963 Pfarrwaller ..... D03D 47/48 139/302
3,457,966 A * 7/1969 Cujai ..... D03D 47/48 139/194

(Continued)

FOREIGN PATENT DOCUMENTS

EP 0 322 014 A1 6/1989
EP 1 280 950 B1 12/2005

(Continued)

OTHER PUBLICATIONS

International Search Report issued in connection with PCT/EP2015/061737.

(Continued)

*Primary Examiner* — Bobby Muromoto, Jr.
(74) *Attorney, Agent, or Firm* — Akerman LLP

(57) ABSTRACT

Weaving machine, device and method for tucking a thread end (11, 12, 24, 25) of a weft thread (10) into a subsequent shed (15), which thread end (11,12,24,25) extends outside a shed (15), wherein thread ends (11, 12, 24, 25) are tucked into a subsequent shed (15) by a tucking device (13,14,28, 29), wherein a thread end (11, 12, 24, 25) is selectively moved by a moveable arm (9, 19), and wherein the thread end (11,12,24,25) moved by the moveable arm (9, 19) beyond the separator element (8, 18) is separated by the separator element (8, 18) from the working area of the tucking device (13, 14, 28, 29).

17 Claims, 6 Drawing Sheets

(56) References Cited

U.S. PATENT DOCUMENTS 3,556,162 A * 1/1971 Sakamoto ..... D03D 47/48 139/302
3,626,991 A * 12/1971 Backenecker ..... D03D 47/40 139/302
3,741,256 A * 6/1973 Wesseler ..... D03C 7/00 139/54
3,841,358 A * 10/1974 Svaty ..... D03C 7/00 139/54
3,945,406 A * 3/1976 Wueger ..... D03C 7/08 139/54
4,076,049 A * 2/1978 Manea ..... D03D 47/48 139/194
4,078,586 A * 3/1978 Porter ..... D03D 47/48 139/434
4,166,480 A * 9/1979 Muller ..... D03C 7/08 139/54
4,589,450 A * 5/1986 Eisenlohr ..... D03C 7/06 139/54
4,957,145 A 9/1990 Verclyte et al.
5,085,253 A * 2/1992 Motta ..... D03C 7/06 139/419
6,006,793 A * 12/1999 Krumm ..... D03C 7/04 139/54
6,092,559 A * 7/2000 Dvorak ..... D03C 7/06 139/50
6,510,871 B2 * 1/2003 Baumann ..... D03C 7/06 139/50
6,957,671 B2 * 10/2005 Pannekoucke ..... D03C 7/00 139/50
7,694,697 B2 4/2010 Lindenmueller et al.
2001/0015235 A1 * 8/2001 Dornier ..... D03C 7/00 139/50
2003/0056846 A1 * 3/2003 Buesgen ..... B60R 21/18 139/1 R
2003/0188794 A1 * 10/2003 Berktold ..... D03C 7/06 139/11
2009/0120526 A1 5/2009 Berktold

FOREIGN PATENT DOCUMENTS

WO 98/28474 A1 7/1998
WO 2006/027240 A1 3/2006
WO 2007/147541 A1 12/2007
WO 2009/007076 A1 1/2009
WO 2013/007551 A2 1/2013

OTHER PUBLICATIONS

Written Opinion of the International Searching Authority issued in connection with PCT/EP2015/061737.
Office Action dated Aug. 1, 2017 in connection with Chinese Patent Application No. 201580031696.7.

* cited by examiner

SELVEDGE FORMING DEVICE FOR A WEFT THREAD

This application is a national phase of PCT/EP2015/061737, filed May 27, 2015, and claims priority to BE 2014/0451, filed Jun. 13, 2014, the entire contents of which are hereby incorporated by reference.

TECHNICAL FIELD

The invention relates to a selvedge forming device comprising a tucking device for tucking a thread end of a weft thread into a subsequent shed, which thread end extends outside a shed, and a moveable arm, wherein the moveable arm is controllable to move thread ends of a fraction of inserted weft threads out of a working area of the tucking device so that the thread ends of the fraction of inserted weft threads is not tucked in.

PRIOR ART

Selvedge forming devices, also named tucking devices, that are arrangeable near an edge of the fabric next to a shed are known amongst others from EP 0 322 014 A1, WO 98/28474 A1, WO 2006/027240 A1 and WO 2009/007076. It is generally known to provide a selvedge forming device at the insertion side of the weft threads and at the opposite side, this means the side opposite the insertion side. When weaving two or more fabrics next to one another, so called middle selvedge forming devices can also be provided between the fabrics.

A problem that occurs when thread ends are tucked into a subsequent shed, is that the fabric obtained has a border at which two weft threads are woven into the fabric, namely the last inserted weft thread and the thread end of the previous weft thread that is tucked in and beaten up with the last inserted weft thread. Hence, this border is thicker than the rest of the fabric. This causes problems when winding up the fabric, especially when weaving a thicker fabric.

To this end, U.S. Pat. No. 3,457,966 proposes that only a limited number of the thread ends of inserted weft threads, in particular only every second thread end is tucked into a subsequent shed and the other thread ends are not tucked in. For this purpose, according to U.S. Pat. No. 3,457,966 a moveable arm is provided that deflects the thread end in accordance with a pattern out of the working area of a tuck-in needle.

DESCRIPTION OF THE INVENTION

It is an object of the invention, to provide a selvedge forming device comprising a tucking device, a weaving machine comprising at least one selvedge forming device and a method for tucking thread ends of a weft thread into a subsequent shed, wherein tucking in of a defined number of thread ends of inserted weft threads is reliably avoided.

According to a first aspect of the invention, a selvedge forming device comprises a tucking device for tucking a thread end of a weft thread into a subsequent shed, which thread end extends outside a shed, and a moveable arm, wherein the moveable arm is controllable to move the thread ends of a fraction of inserted weft threads out of the working area of the tucking device, and wherein the selvedge forming device further comprises a stationary separator element, wherein the moveable arm is controllable to move the thread end beyond the separator element out of the working area of the tucking device. In the context of the application controllable means can be controlled at a certain moment, in other words can be activated to move the moveable arm, in particular to move the moveable arm in accordance with a predefined pattern and/or at a predefined moment in the weaving cycle for predefined weft threads.

The thread end moved beyond the separator element is separated by the separator element from the working area of the tucking device. In the context of the application the working area of the tucking device is the area in which the tucking device can take up a thread end in order to tuck the thread end in a subsequent shed. After an insertion of a weft thread, the thread end of the inserted weft thread can pass at one side of the separator element at which side the working area of the tucking device is located, wherein by means of a movement of the moveable arm the thread end is moved beyond the separator element to the side of the separator element opposite to the side of the working area. This allows the thread end that could be tucked into the shed by the tucking device to be reliably kept out of the working area of the tucking device. According to the invention the selvedge forming device allows to tuck-in only a limited number of the weft threads and to not tuck-in the thread ends of a fraction of inserted weft threads, in other words a defined number of weft threads, so that a selvedge can be obtained on the fabric, which selvedge has a limited thickness.

According to an embodiment, the separator element is provided with a support surface onto which at least the thread end moved out from the working area of the tucking device is supported, which support surface is preferably arranged above an insertion level of the weft thread. In the context of the application, the insertion level is defined as the height of the path of the inserted weft thread. The moveable arm takes up the weft thread at the insertion level and moves upwards beyond the separator element. When the moveable arm is moving back to its lower position, the thread end moved above the separator element will rest on the support surface of the separator element due to gravity forces and/or bending forces. Moving the thread ends upwards is in particular advantageous in combination with a tucking device that approaches the thread end to be tucked in from underneath the insertion level. In this case, a collision of the moveable arm and the tucking device is avoided even if the moveable arm is moved back to its lower position before the tucking device has finished its take-up motion. The thread end continuously resting on a support surface of the separator element allows that the thread end that is moved by the moveable arm beyond the separator element is kept continuously separated from the working area of the tucking device. This offers the advantage that a thread end that rests on the separator element can never return into the working area of the tucking device, so that such a thread end will not be tucked in together with a thread end of a later inserted weft thread.

The selvedge forming device in preferred embodiments comprises a holding device, wherein a thread end held by the holding device is presented to the tucking device. The tucking device in preferred embodiments pulls the thread ends to be tucked in out of the holding device.

In other embodiments, the thread ends are actively released by means of the holding device. When the thread end is moved beyond the separator element, the thread end is also pulled out of the holding device by the moveable arm and subsequently released by the holding device.

In some embodiments, the tucking device is a needle, in particular a hook-shaped needle, wherein the moveable arm is selectively activated, in other words is selectively controlled, to move the thread end out of a working area of the needle. The needles are driven to move the thread end below the insertion level. A possible drive for the needle is disclosed in WO 98/28474 A1. Other drives for the needle are also possible.

In other embodiments, the tucking device is a pneumatic device, wherein the moveable arm is selectively controlled to move the thread end out of the working area of airjets supplied by the pneumatic device. A possible pneumatic tucking device is disclosed in WO 2009/007076 A1. Other pneumatic tucking devices are also possible, for example pneumatic tucking devices with one or more airjets.

Regardless of the tucking device used, in an embodiment at least one blowing device is provided, which blowing device is controllable for moving the thread end out of the working area of the tucking device. The blowing device assists the moveable arm to move a thread end beyond the separator element or to keep beyond the separator element.

In preferred embodiments, the moveable arm is provided with a first hook-shaped distal end and/or the separator element is provided with a second hook-shaped distal end. Such a hook-shaped distal end is advantageous for taking up and/or retaining the thread ends.

In an embodiment, the moveable arm is mounted to be moved to and fro by means of a drive system. In preferred embodiments, the moveable arm is mounted so as to be rotatable to and fro about an axis to move the thread end beyond the separator element. With such an arrangement, the movement of the moveable arm is guided in a better way.

In preferred embodiments, a drive system with an eccentric drive is provided for driving the moveable arm, in particular an eccentric drive comprising a pneumatic cylinder, which pneumatic cylinder is acting on a drive plate coupled to the moveable arm. The pneumatic cylinder is a single acting or, preferably, a double-acting pneumatic cylinder.

According to a second aspect, a weaving machine comprising at least one selvedge forming device is provided, which selvedge forming device is arranged near a fabric edge. The weaving machine for example is a rapier weaving machine or an airjet weaving machine.

According to a third aspect, a method for tucking a thread end of a weft thread in a subsequent shed is provided, which thread end extends outside a shed, wherein thread ends are tucked into a subsequent shed by means of a tucking device, wherein a thread end is selectively moved out of the working area of the tucking device and beyond a separator element by means of a moveable arm, and wherein the thread end moved beyond the separator element is separated by a separator element from the working area of the tucking device.

As described above, in some embodiments, a blowing device supplying an airjet is provided to assist the moveable arm in moving the thread end beyond the separator element.

In preferred embodiments, the thread end is moved upwards by the moveable arm.

Preferably, the moveable arm is rotatable to and fro about an axis to move the thread end beyond the separator element. For example, the moveable arm is rotatable by means of a pneumatic cylinder acting offset to the said axis on the moveable arm.

In preferred embodiments, the tucking device comprises a needle. In some embodiments, the needle is advanced to take up the thread end while the thread end is already moved beyond the separator element. In other words, the moveable arm and the moveable needle can move at overlapping times, however the moveable arm already moves the thread end out of the working area of the moveable needle before the moveable needle can take up the thread end.

BRIEF DESCRIPTION OF THE DRAWINGS

Further features and advantages of the invention derive from the following description of the embodiments shown in the drawings and the dependent claims, wherein:

DETAILED DESCRIPTION OF EMBODIMENTS

Figure 1:
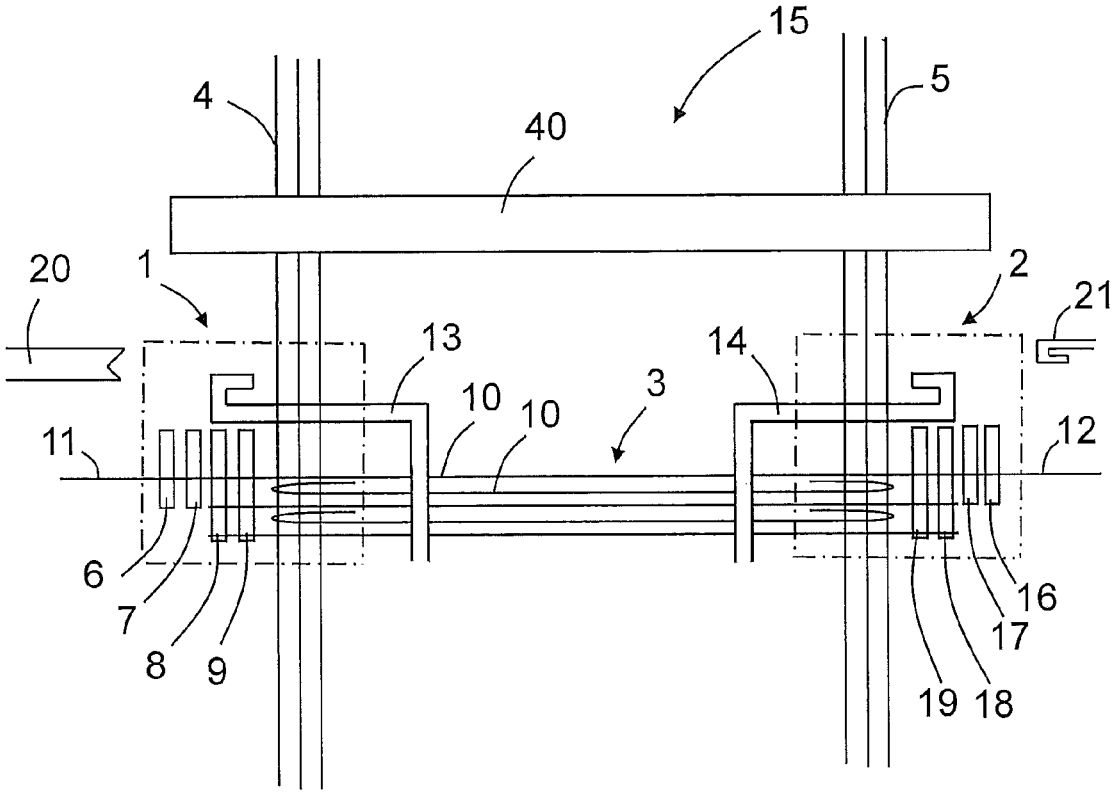
FIG. 1 shows schematically a rapier weaving machine with two selvedge forming devices according to the invention.

FIG. 1 schematically shows a weaving machine with two selvedge forming devices 1 and 2 according to the invention. The selvedge forming device 1 of FIG. 1 is shown in more detail in FIG. 2.

The weaving machine shown in FIG. 1 is, for example, a rapier weaving machine with a feed rapier 20 and a receiving rapier 21 that are arranged to insert a weft thread 10 in a shed 15. The selvedge forming device 1 is mounted near the fabric edge 4 of the fabric 3 at the insertion side. The selvedge forming device 2 is mounted near the fabric edge 5 of the fabric 3 on the opposite side of the insertion side.

Figure 2:
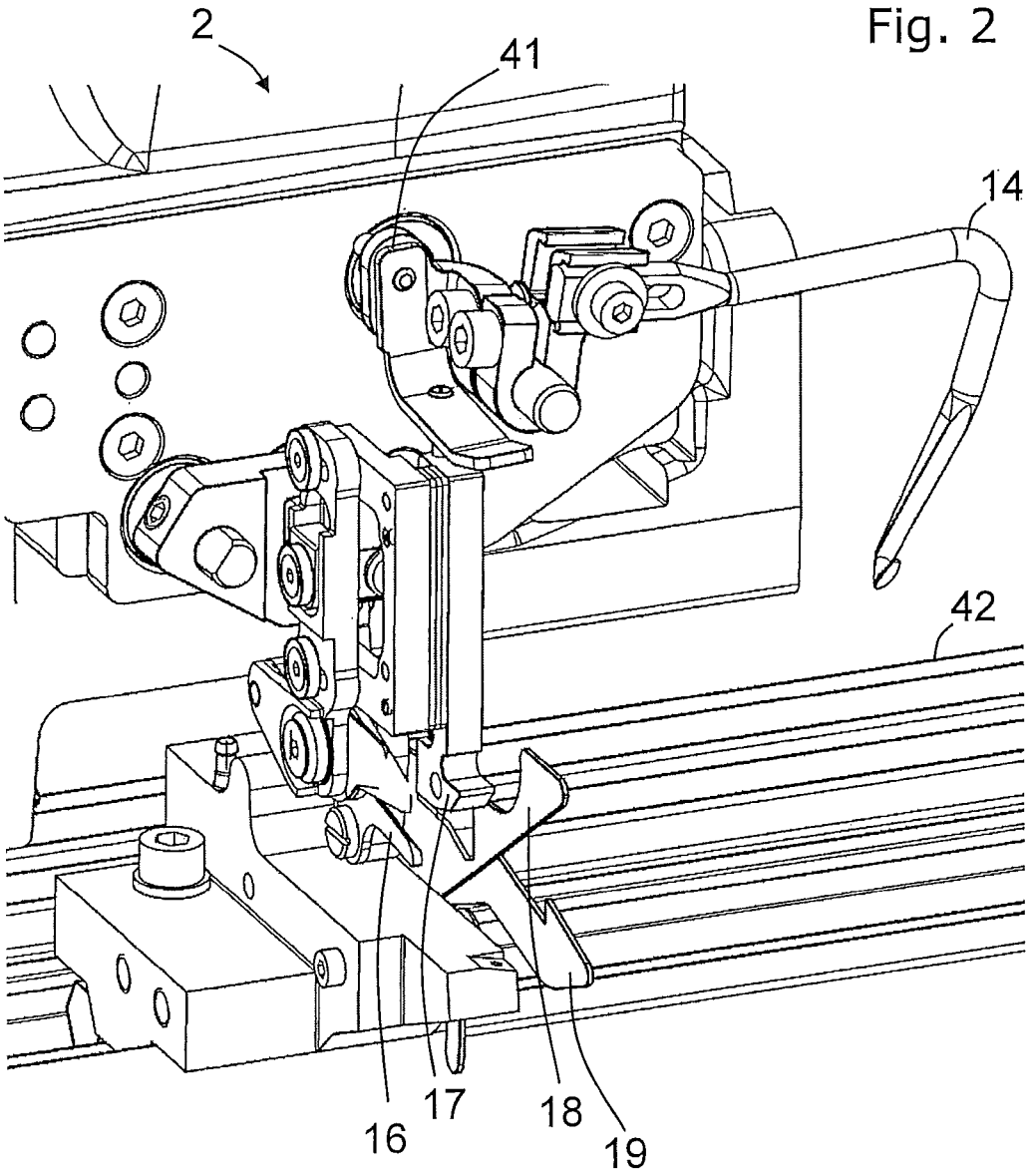
FIG. 2 shows the selvedge forming device of FIG. 1 in a front view with respect to the reed.

The selvedge forming device 2 as shown in more detail in FIG. 2 comprises a weft cutter 16 for cutting a thread end 12 which extends outside the fabric edge 5 of the fabric 3, a holding device 17 for holding the thread end 12, and a tucking device 14 in the form of a hook-shaped needle for tucking a the thread end 12 into a subsequent shed 15. In order to tuck the thread end 12 into the subsequent shed 15, the tucking device 14 is rotated to and fro by a drive axis 41 to grip a thread end 12 presented to the holding device 17 and to tuck into the subsequent shed 15. The thread end 12 tucked into the subsequent shed 15 is beaten up by means of the reed 40 together with a subsequently inserted weft thread, in particular with the succeeding weft thread.

According to the invention, the selvedge forming device 2 is arranged to optionally prevent tucking in of a thread end 12 into a subsequent shed 15, so that only a defined fraction of thread ends 12 is tucked in. For this purpose, a moveable arm 19 for selectively moving the thread end 12 out of a working area of the tucking device 14 and a stationary arranged separator element 18 for keeping separated the thread end 12 from the working area of the tucking device 14 are provided. The thread end 12 is only presented to the tucking device 14 when the thread end 12 is located in the working area of the tucking device 14. A thread end 12 not presented to the tucking device 14 and separated from the working area will not be tucked in.

Similarly, the selvedge forming device 1 provided at the opposite side comprises a weft cutter 6 for cutting a thread end 11 which extends outside the fabric edge 4 of the fabric 3, a holding device 7 for holding the thread end 11, a tucking device 13 in the form of a hook-shaped needle for tucking in the thread end 11 into a subsequent shed 15, a moveable arm 9 for selectively moving the thread end 11 out of the working area of the tucking device 13, and a separator element 8 for retaining the thread end 11 moved out of the working area. The selvedge forming device 1 is essentially identical in construction, but mirrored to the selvedge forming device 2.

Figure 3:
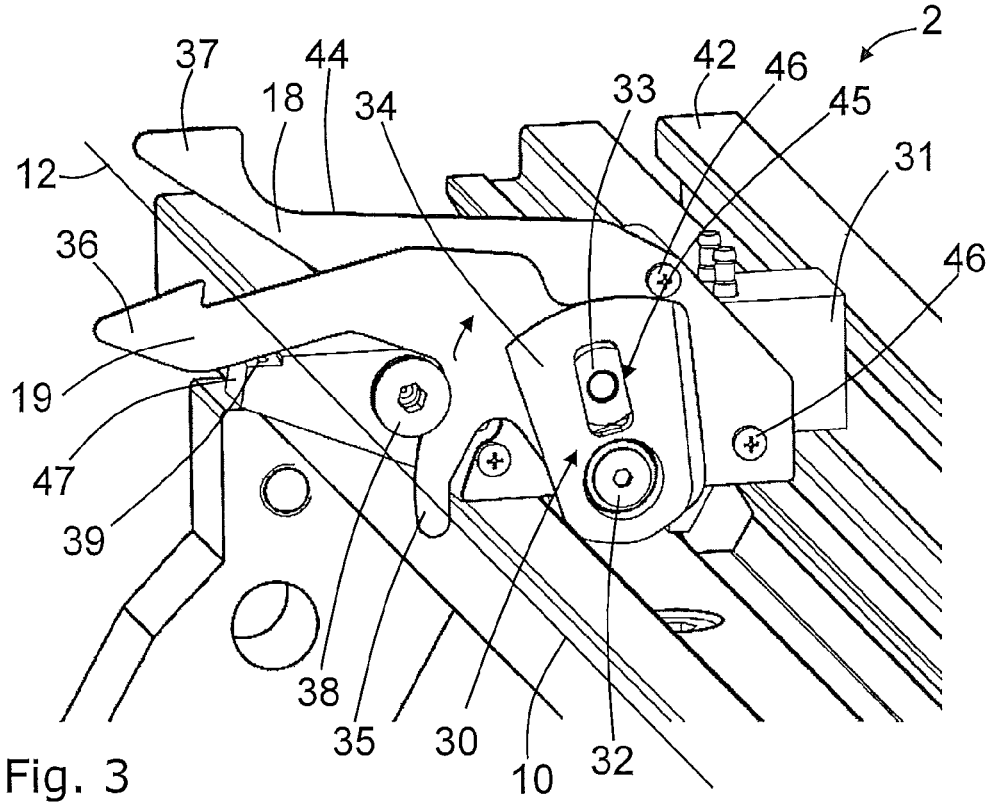
FIG. 3 shows the selvedge forming device of FIG. 1 in a first stage in use.

As shown in FIG. 3, the moveable arm 19 is arranged to be rotated about an axis 32 parallel to the insertion direction. A thread end 12 is shown after this thread end 12 has been inserted into the shed 15. The moveable arm 19 is arranged in order to move the thread end 12 to a position above the level of an inserted weft thread 10, also named insertion level. This is in particular advantageous in case the tucking device 14 is advanced towards the presented thread end 12 from underneath the insertion level. The moveable arm 19 is arranged to move the thread end 12 towards and beyond the separator element 18.

The separator element 8 and the moveable arm 9 are arranged mirrored to the separator element 18 and the moveable arm 19, and are arranged to bring or to move the thread end 11 to a position above the level of the inserted weft thread 10 and beyond the separator element 8.

In an embodiment, the holding device 7, 17 is a pneumatic holding device, in particular a holding device as shown in WO 2013/007551 A2, the content of which is hereby incorporated by reference. However, in other embodiments, different types of holding devices may be used, for example mechanical thread clamps.

The selvedge forming devices 1 and 2 in the embodiment shown are mounted on a support beam 42, wherein a position of the selvedge forming devices 1 and 2 along the support beam 42 can be adapted to the weaving width of the fabric 3 to be woven.

As shown in FIG. 1 the thread end 11 of an inserted weft thread 10 is held by the holding device 7 and subsequently, the weft thread 10 is cut by the weft cutter 6 while the thread end 11 of the weft thread 10 being held by the holding device 7. The tucking device 13 is advanced for example towards the thread end 11 presented between the fabric edge 4 and the holding device 7, takes up the presented thread end 11 and tucks the thread end 11 into a subsequent shed.

Figure 4:
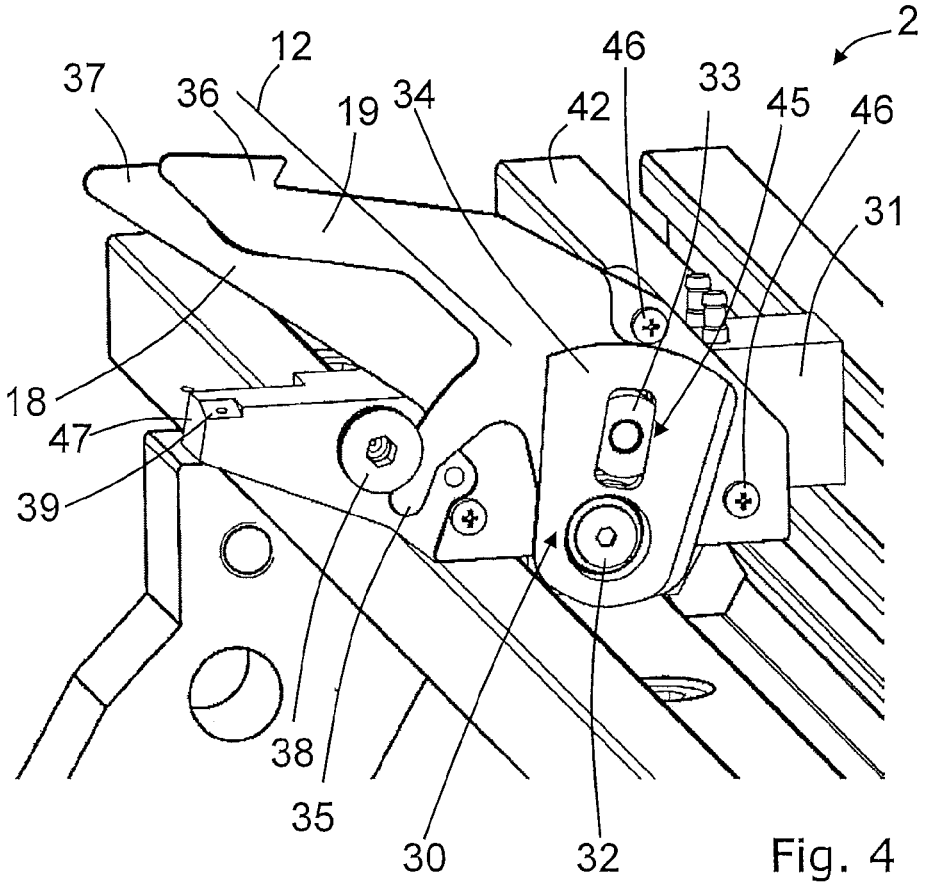
FIG. 4 shows the selvedge forming device of FIG. 1 in a second stage in use.
Figure 5:
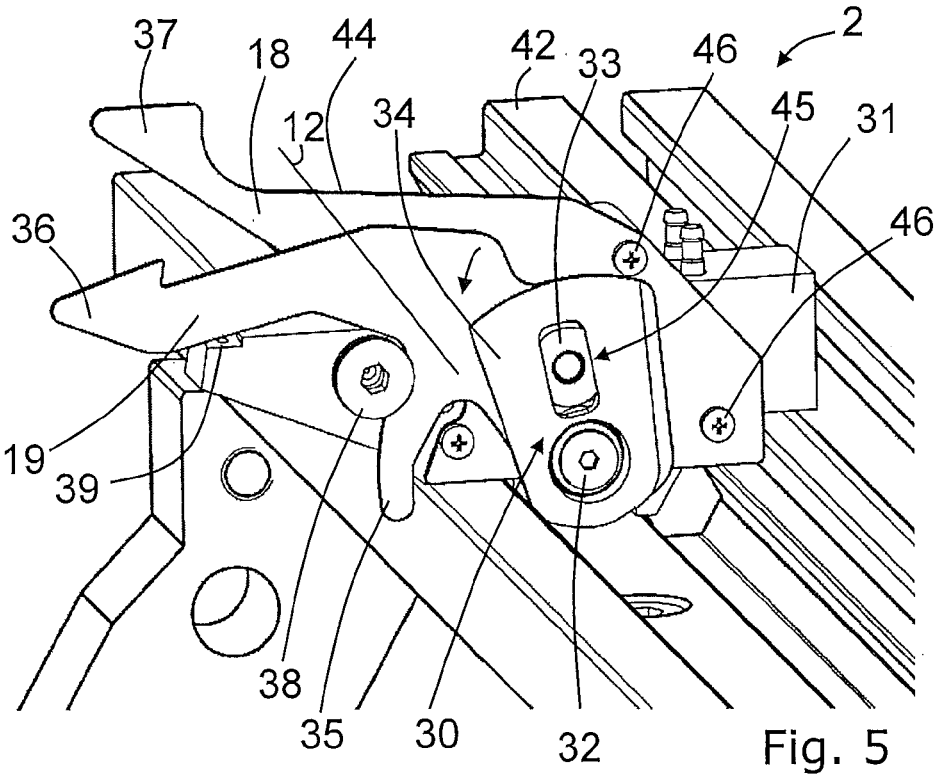
FIG. 5 shows the selvedge forming device of FIG. 1 in a third stage in use.

FIGS. 3 to 5 show the separator element 18 and the moveable arm 19 of the selvedge forming device 2 of FIGS. 1 and 2 in a perspective view in different stages upon moving a thread end 12, that not has to be tucked, out of the working area of the tucking device 14. When the thread and 12 is not to be tucked, the moveable arm 19 as shown in FIG. 4 moves upwards and moves the thread end 12 out of the working area of the tucking device 14, this means towards a position where the tucking device 14 cannot take up the thread end 12. Upon moving the thread end 12 upwards, the thread end 12 is pulled out of the holding device 17 and brought above the separator element 18. Next, as shown in FIG. 5, the moveable arm 19 moves back to its lower position. The thread end 12 moved above the separator element 18 is prevented by the separator element 18 from moving back with the moveable arm 19. Due to gravity forces, the thread end 12 will rest at a support surface 44 at the upper side of the separator element 18.

During the movement of the moveable arm 19 out of and back into its lower position, the tucking device 14 can start its movement for taking up a thread end 12. The tucking device 14 will pass below the separator element 18 near the holding device 17 and attempt to take up a thread end 12. When the thread end 12 has been moved out of the working area of the tucking device 14, and is securely separated from the working area of the tucking device 14 by the separator element 18, the tucking device 14 will not be able to take up the thread end 12 and the thread end 12 will not be tucked in into the shed.

Tucking the thread end 11, 12 is only prevented when the moveable arm 9, 19 has moved the thread end 11, 12. Hence, the tucking devices 13 and 14 of the selvedge forming devices 1 and 2 can be operated as prior art selvedge forming devices 1, 2 that are intended to tuck in all thread ends. A movement of the moveable arm 9, 19 in one embodiment is controlled by a drive system 30 controlled by a control unit.

Figure 6:
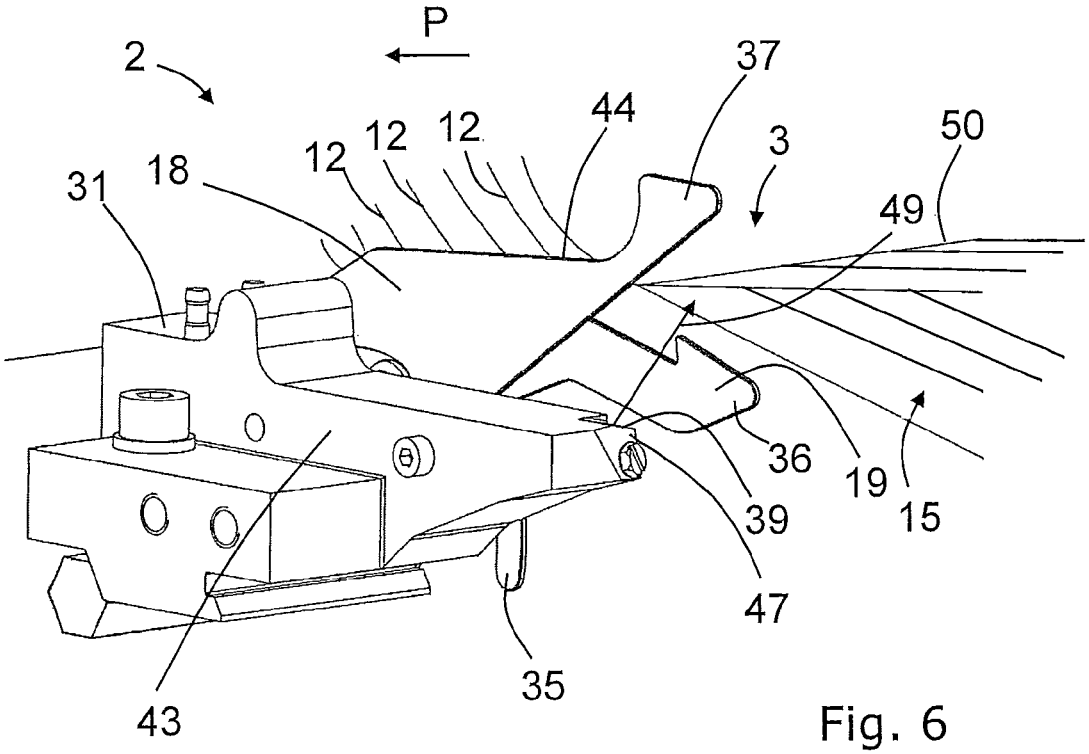
FIG. 6 shows a moveable arm and a separator element of FIG. 5 in another perspective view.

The stationary separator element 18 is fixedly arranged with screws 46 to a holder 31 and mounted by means of the holder 31 to the support beam 42. For example, the holder 31 is arranged to the support beam 42 with fixing means as known from WO 2007/147541 A1. The moveable arm 19 is mounted rotatable about an axis 32 fixed to the holder 31. A drive system 30 is provided to rotate the moveable arm 19 to and fro. The drive system 30 comprises for example an eccentric drive 45 with a drive element 33 moved linear to and fro and a drive plate 34 fixedly connected to the moveable arm 19. The moveable arm 19 and the drive plate 34 are fixedly arranged together to the axis 32 rotatable arranged in the holder 31. The drive element 33 is arranged offset to the axis 32 and coupled to the drive plate 34. In preferred embodiments, the drive element 33 is moved linear to and fro by means of a pneumatic cylinder unit 43, of which only the housing is schematically shown in FIG. 6, in particular a double acting pneumatic cylinder. The pneumatic cylinder unit 43 for moving the drive element 33 to and fro comprises for example a double acting pneumatic cylinder mounted inside the holder 31.

For obtaining stability in the movement of the moveable arm 19, a stationary arranged guide element 38 and a collar 35 are provided, which collar 35 is integrally formed with the moveable arm 19. Further, in the embodiment shown, the moveable arm 19 is provided with a hook-shaped distal end 36. The separator element 18 is also provided with a hook-shaped distal end 37. The hook-shaped distal ends 36, 37 improve taking up and retaining of thread ends 12.

FIG. 6 shows the moveable arm 19 and the separator element 18 of FIGS. 3 to 5 in another perspective. In this case a blowing device 39 in the top 47 of the holder 31 is shown. By means of the blowing device 39 at least one airjet 49 is supplied to blow the thread end 12 out of the working area of the tucking device 14 and to assist in this way the moveable arm 19 to move the thread end 12 to the separator element 18. As shown in FIG. 6 a number of thread ends 12 that are not tucked in the fabric 3 remain lying on the separator element 18 until these thread ends 12 are moved in a direction P by means of the fabric 3 away from the hook-shaped distal end 37 of the separator element 18. In FIG. 6 the shed 15 and the beat-up line 50 of the fabric 3 are shown schematically.

Figure 7:
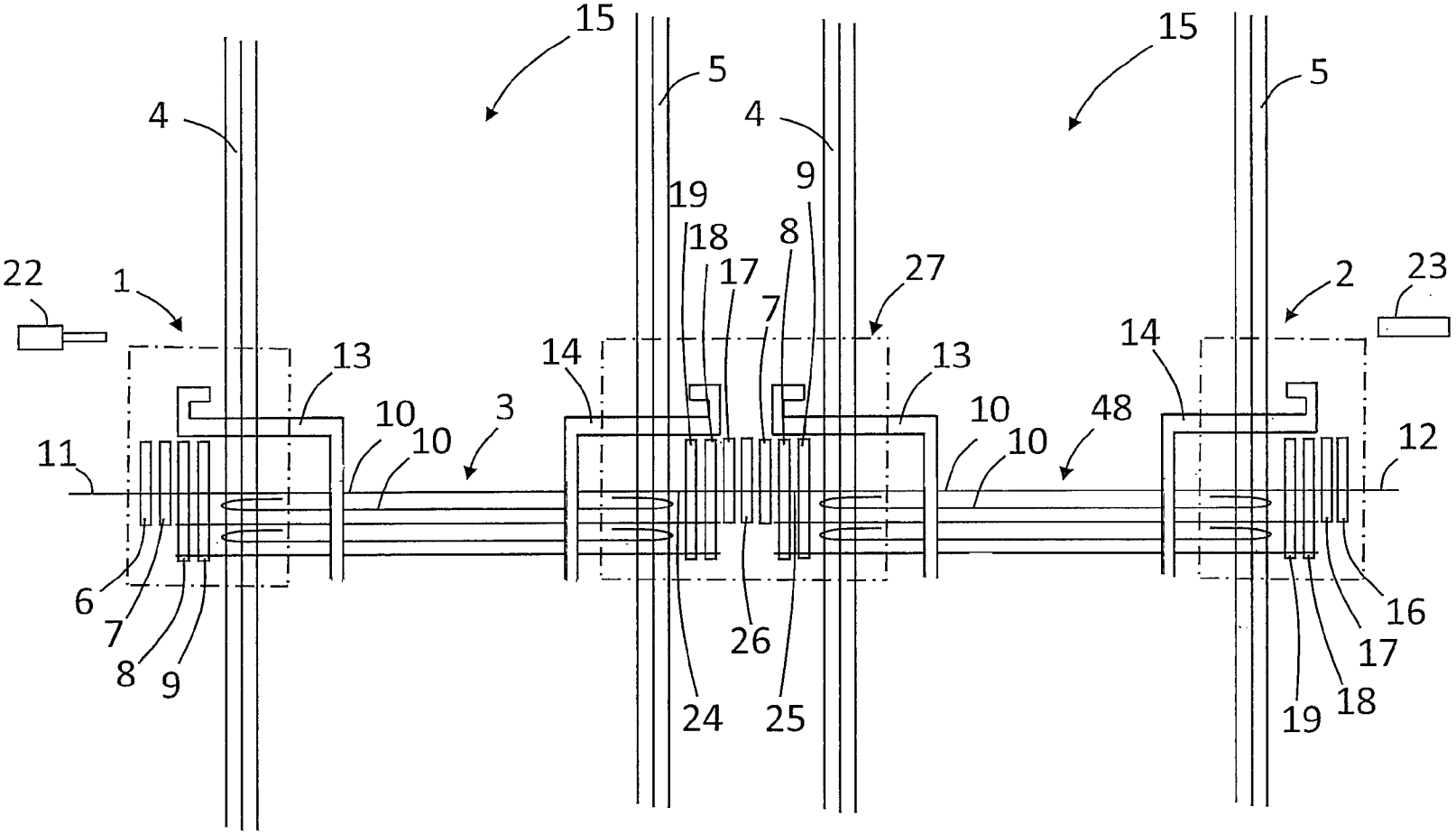
FIG. 7 shows schematically an airjet weaving machine for weaving two fabrics with three selvedge forming devices according to the invention.

FIG. 7 schematically shows a weaving machine, in particular an airjet weaving machine with a main blower device 22 and a stretching device 23, wherein two fabrics 3 and 48 are woven next to each other. At each of the two outer fabric edges 4 and 5, an associated selvedge forming device 1, 2 is provided. In addition, in this embodiment, a so called middle selvedge forming device 27 is provided. The middle selvedge forming device 27 is similar to a combination of the selvedge forming devices 1 and 2, wherein only one common thread cutter 26 is provided for cutting the inserted weft thread 10 in order to obtain two thread ends 24 and 25 to be tucked in, or in case the associated moveable arms 9, 19 are operated not to be tucked in.

Figure 8:
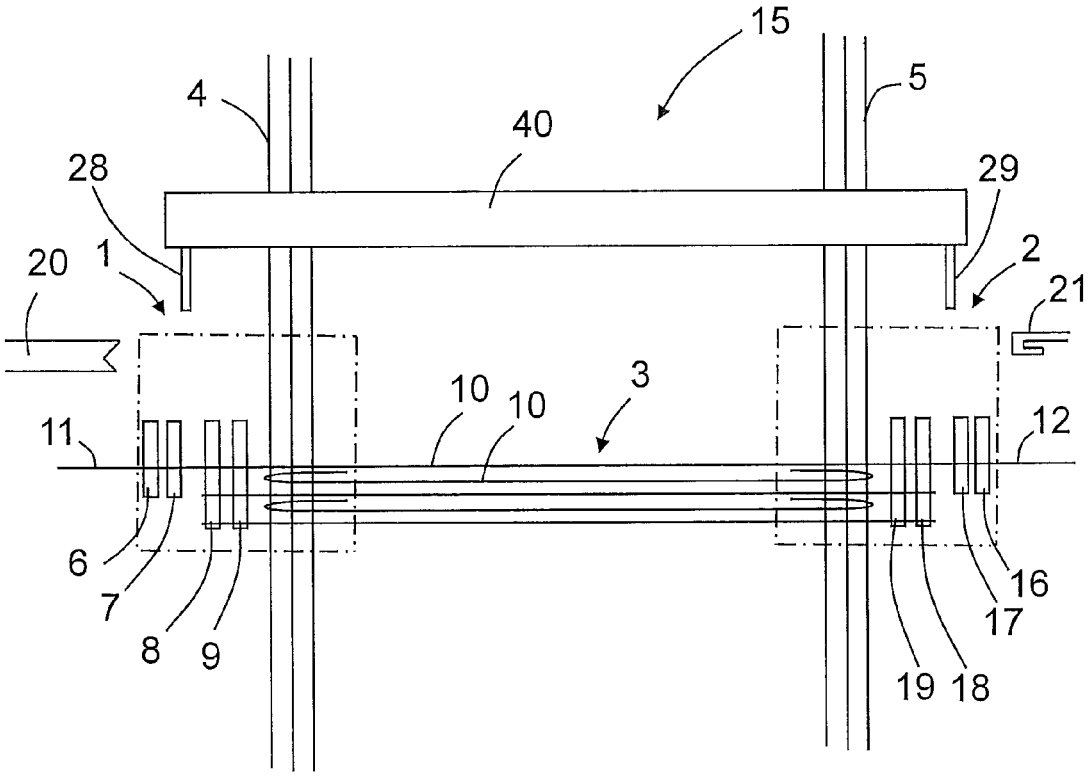
FIG. 8 shows schematically a rapier weaving machine with two selvedge forming devices according to another embodiment of the invention.

FIG. 8 shows an alternative embodiment of the weaving machine with two selvedge forming devices 1 and 2 similar to FIG. 1. In contrast to the embodiment shown in FIG. 1, the thread ends 11 and 12 are not tucked into the shed 15 by means of a tucking device 13, 14 formed by needles. Instead of the needles, blowing devices are provided as tucking device 28, 29 for tucking in the thread ends 11, 12. In an embodiment, the blowing devices are embodied as shown in WO 2009/007076 A1, the content of this document is hereby incorporated by reference. In an alternative the blowing devices can be embodied as shown in EP 1 280 950 B1, the content of this document is hereby incorporated by reference. In case a thread end 11, 12 is not to be tucked in, the moveable arm 9, 19 is controlled to move the thread end 11, 12 out of the working area of airjets supplied by the tucking devices 28, 29, so that the thread ends 11, 12 are not tucked into a subsequent shed.

The weft cutters 6, 16, 26, the holding devices 7, 17, the tucking devices 13, 14 and/or the tucking devices 28, 29 can be embodied as a prior art selvedge forming device. Though it is preferred to drive the moveable arm 9, 19 by means of a pneumatic drive system 30, as a pneumatic drive system can deliver a large force to pull a thread end 11, 12 out of a holding device 7, 17, of course also an electric drive system 30 can be used, or even a mechanical drive system 30 that comprises a transmission device, such as a cam, driven by the main drive shaft of the weaving machine.

It is clear to the person skilled in the art, that the selvedge forming devices 1, 2, 27 according to the invention can be arranged at any type of weaving machine. The position of the selvedge forming devices 1, 2, 27 can be adapted to the weaving width of the fabric to be woven.

Due to the fact that a separator element 8, 18 according to the invention is used, the advantage is obtained that the thread ends 11, 12, 24, 25 which are not tucked in, can never return to the working area of the tucking devices 13, 14 or 28, 29. This means that the separator elements 8, 18 keep the thread ends 11, 12, 24, 25 continuously separated from the working area of the tucking devices 13, 14 or 28, 29, and not only keep the thread ends 11, 12, 24, 25 separated from the working area for the last inserted weft thread. Of course, nothing prevents to provide for example besides the separator elements 8, 18 even a blowing device 39 to keep the thread ends 11, 12, 24, 25 of the last inserted weft thread additionally separated of the tucking devices 13, 14 or 28, 29.

The selvedge forming device and the weaving machine are not limited to the embodiments described by way of example and illustrated in the drawings, also alternatives and combinations of the described and illustrated embodiments are possible that fall under the claims.

The invention claimed is:

1. A selvedge forming device comprising:

a tucking device for tucking a thread end of a weft thread into a subsequent shed, which thread end extends outside a shed, and a moveable arm, wherein the moveable arm is controllable to move thread ends of a fraction of inserted weft threads out of the working area of the tucking device, and a stationary separator element, wherein the moveable arm is controllable to move the thread end beyond the separator element out of the working area of the tucking device.

2. The selvedge forming device according to claim 1, wherein the separator element is provided with a support surface onto which the thread end moved out of the working area of the tucking device is supported, which support surface is arranged above an insertion level of the weft thread.

3. The selvedge forming device according to claim 1, wherein the separator element is provided with a support surface onto which a number of thread ends moved out of the working area of the tucking device are supported.

4. The selvedge forming device according to claim 1, wherein the selvedge forming device comprises a holding device, wherein a thread end held by the holding device is pulled out of the holding device by the moveable arm and is moved beyond the separator element.

5. The selvedge forming device according to claim 1, wherein the tucking device comprises a needle, wherein the moveable arm is selectively controllable to move the thread end out of the working area of the tucking device.

6. The selvedge forming device according to claim 1, wherein the tucking device comprises a pneumatic device, wherein the moveable arm is selectively controllable to move the thread end out of the working area of airjets supplied by the pneumatic device.

7. The selvedge forming device according to claim 1, wherein the moveable arm is provided with a hook-shaped distal end.

8. The selvedge forming device according to claim 1, wherein the separator element is provided with a hook-shaped distal end.

9. The selvedge forming device according to claim 1, wherein at least one blowing device is provided, which blowing device is controllable to move a thread end out of the working area of the tucking device.

10. The selvedge forming device according to claim 1, wherein the moveable arm is mounted so as to be rotatable to and fro about an axis in order to move the thread end beyond the separator element.

11. The selvedge forming device according to claim 10, wherein a drive system with an eccentric drive is provided for driving the moveable arm.

12. A weaving machine comprising at least one selvedge forming device according to claim 1, which selvedge forming device is arranged near a fabric edge.

13. A method for tucking a thread end of a weft thread into a subsequent shed which thread end extends outside a shed comprising:

tucking thread ends into a subsequent shed by tucking device means and;

selectively moving a thread end by a moveable arm out of the working area of the tucking device wherein the thread end is moved by the moveable arm beyond a separator element and;

separating the thread end from the working area of the tucking device by the separator element.

14. The method according to claim 13, wherein the thread end is moved upwards by the moveable arm.

15. The method according to claim 13, wherein the moveable arm is rotatable to and fro about an axis to move the thread end beyond the separator element.

16. The selvedge forming device according to claim 5 wherein the needle is a hook shaped needle.

17. The selvedge forming device according to claim 11, wherein the eccentric drive comprises a pneumatic cylinder unit which acts on a drive plate coupled to the moveable arm.

* * * * *